US008166885B2

(12) United States Patent
Kitchen

(10) Patent No.: US 8,166,885 B2
(45) Date of Patent: May 1, 2012

(54) SUSPENDED CABLE AMUSEMENT RIDE

(75) Inventor: William J. Kitchen, Windmere, FL (US)

(73) Assignee: William J. Kitchen, Windermere, FL (US)

( * ) Notice: Subject to any disclaimer, the term of this patent is extended or adjusted under 35 U.S.C. 154(b) by 0 days.

(21) Appl. No.: 12/997,038

(22) PCT Filed: Feb. 12, 2010

(86) PCT No.: PCT/US2010/024177

§ 371 (c)(1),
(2), (4) Date: Feb. 21, 2011

(87) PCT Pub. No.: WO2010/093984

PCT Pub. Date: Aug. 19, 2010

(65) Prior Publication Data

US 2011/0132224 A1 Jun. 9, 2011

Related U.S. Application Data

(60) Provisional application No. 61/151,919, filed on Feb. 12, 2009.

(51) Int. Cl.
*B61B 12/10* (2006.01)
*B61B 10/02* (2006.01)

(52) U.S. Cl. ..... 104/189; 104/191; 105/149.1

(58) Field of Classification Search ..... 104/87, 104/112, 113, 115, 123–125, 173.1, 173.2, 104/178, 180, 190, 191, 197, 189; 105/149.1, 105/149.2; 242/615

See application file for complete search history.

(56) References Cited

U.S. PATENT DOCUMENTS

| | | | | |
|---|---|---|---|---|
| 959,595 | A * | 5/1910 | Pfaffenbagh | 104/91 |
| 1,229,519 | A | 6/1917 | Rach | |
| 2,311,171 | A | 2/1943 | Hawthorne | |
| 2,779,596 | A | 1/1957 | Ridgway | |
| 3,476,385 | A | 11/1969 | Foy | |
| 3,701,528 | A | 10/1972 | Ryan | |
| 4,608,930 | A * | 9/1986 | Galmiche | 104/180 |
| 4,978,120 | A | 12/1990 | Greenwood | |
| 5,094,448 | A | 3/1992 | Hackett | |
| 5,105,745 | A * | 4/1992 | Tarassoff | 104/179 |
| 5,203,744 | A | 4/1993 | Checketts | |
| 5,224,425 | A | 7/1993 | Remington | |

(Continued)

FOREIGN PATENT DOCUMENTS

AU A-75360/96 6/1997

(Continued)

OTHER PUBLICATIONS

International Search Report for parent PCT application No. PCT/US2010/024177 mailed on Oct. 19, 2010 (4 page).

(Continued)

*Primary Examiner* — S. Joseph Morano
*Assistant Examiner* — Zachary Kuhfuss
(74) *Attorney, Agent, or Firm* — Margaret Polson Oppedahl Patent Law Firm LLC

(57) ABSTRACT

An suspended cable amusement ride is disclosed. The cable is supported by turning beam assemblies and moved by turning beam drive assemblies. The turning beam assemblies and turning beam drive assemblies each have multiple sheave wheels supported in brackets along a turning beam. In the turning beam drive assembly the sheave wheels are driven by motors operably attached to the sheave wheels.

26 Claims, 14 Drawing Sheets

U.S. PATENT DOCUMENTS

| | | | | |
|---|---|---|---|---|
| 5,267,906 | A | 12/1993 | Kitchen et al. | |
| 5,527,223 | A | 6/1996 | Kitchen et al. | |
| 5,931,740 | A | 8/1999 | Kitchen | |
| 5,979,333 | A | 11/1999 | Houben et al. | |
| 6,360,669 | B1 * | 3/2002 | Albrich | 104/93 |
| 6,416,418 | B1 | 7/2002 | Kleimeyer | |
| 6,443,847 | B1 | 9/2002 | van Asch et al. | |
| 6,569,024 | B2 | 5/2003 | Kleimeyer | |
| 6,622,634 | B2 | 9/2003 | Cylvick | |
| 6,666,773 | B1 | 12/2003 | Richardson | |
| 7,066,822 | B2 | 6/2006 | Cochron | |
| 7,156,714 | B2 * | 1/2007 | Kian et al. | 441/74 |
| 7,299,752 | B1 | 11/2007 | Cylvick | |
| 7,559,281 | B2 * | 7/2009 | Huard et al. | 104/173.1 |
| 7,814,857 | B2 | 10/2010 | Hally | |
| 2003/0017880 | A1 | 1/2003 | Kleimeyer | |
| 2005/0239563 | A1 | 10/2005 | Pondorfer et al. | |
| 2006/0137563 | A1 | 6/2006 | Cummins | |
| 2006/0157298 | A1 | 7/2006 | Beggrow et al. | |
| 2006/0252562 | A1 | 11/2006 | Anderson et al. | |
| 2009/0151594 | A1 * | 6/2009 | Dur et al. | 104/112 |
| 2010/0147180 | A1 * | 6/2010 | Perry | 104/112 |
| 2011/0083577 | A1 * | 4/2011 | Tilley | 104/96 |

FOREIGN PATENT DOCUMENTS

| | | | |
|---|---|---|---|
| AU | 744294 | | 11/1998 |
| AU | 744299 | | 11/1998 |
| AU | 744301 | | 11/1998 |
| CH | 678841 | A * | 11/1991 |
| JP | 57-029388 | | 2/1982 |
| JP | 02003571 | A * | 1/1990 |
| WO | 02/085478 | | 10/2002 |

OTHER PUBLICATIONS

Written Opinion of the International Searching Authority for parent PCT application No. PCT/US2010/024177 mailed on Oct. 19, 2010 (5 pages).

* cited by examiner

SUSPENDED CABLE AMUSEMENT RIDE

CROSS REFERENCE APPLICATIONS

This application is a National Stage entry of PCT/US2010/0024177 filed Feb. 12, 2010 which claims priority from U.S. provisional application No. 61/151,919 filed Feb. 12, 2009.

BACKGROUND

Amusement rides are well known in the art. The amusement ride industry has seen an increasing growth in what are called thrill rides, rides that provide the appearance of danger to the rider. Rides such as swing rides, sling shot rides and bungee jumps are among the many thrill rides currently known. The safety of the rider is always a primary concern, and always constrains the design of rides. Other concerns include cost of installation and maintenance, the size of the footprint (space needed on the ground) and number of riders that can use the ride in a given interval of time. Various types of cable supported rides are well known, including ski lifts and other similar rides. Cable rides are generally not considered suitable for thrill rides because of the difficulties of moving the rider at the speeds necessary for a thrill ride while being able to make sharp turns also considered desirable in a thrill ride.

The foregoing examples of the related art and limitations related therewith are intended to be illustrative and not exclusive. Other limitations of the related art will become apparent to those of skill in the art upon a reading of the specification and a study of the drawings.

SUMMARY

An aspect of the amusement ride disclosed is to provide a cable supported ride that is suitable for use as a thrill ride.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

The amusement ride is a suspended cable loop that has a means for conveying multiple riders in a generally front down prone position. The riders are suspended from cables, and are not on a rigid rider conveyance. To ensure rider safety there are a number of means to reduce and/or limit the amount of sway and/or twisting that the rides can experience.

A second embodiment of the amusement ride is a people mover type ride using the turning beam drive assembly.

Another embodiment is a means of suspending a rider from attachment locations that act to dampen the sway experienced by the rider caused by the motion of the ride.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
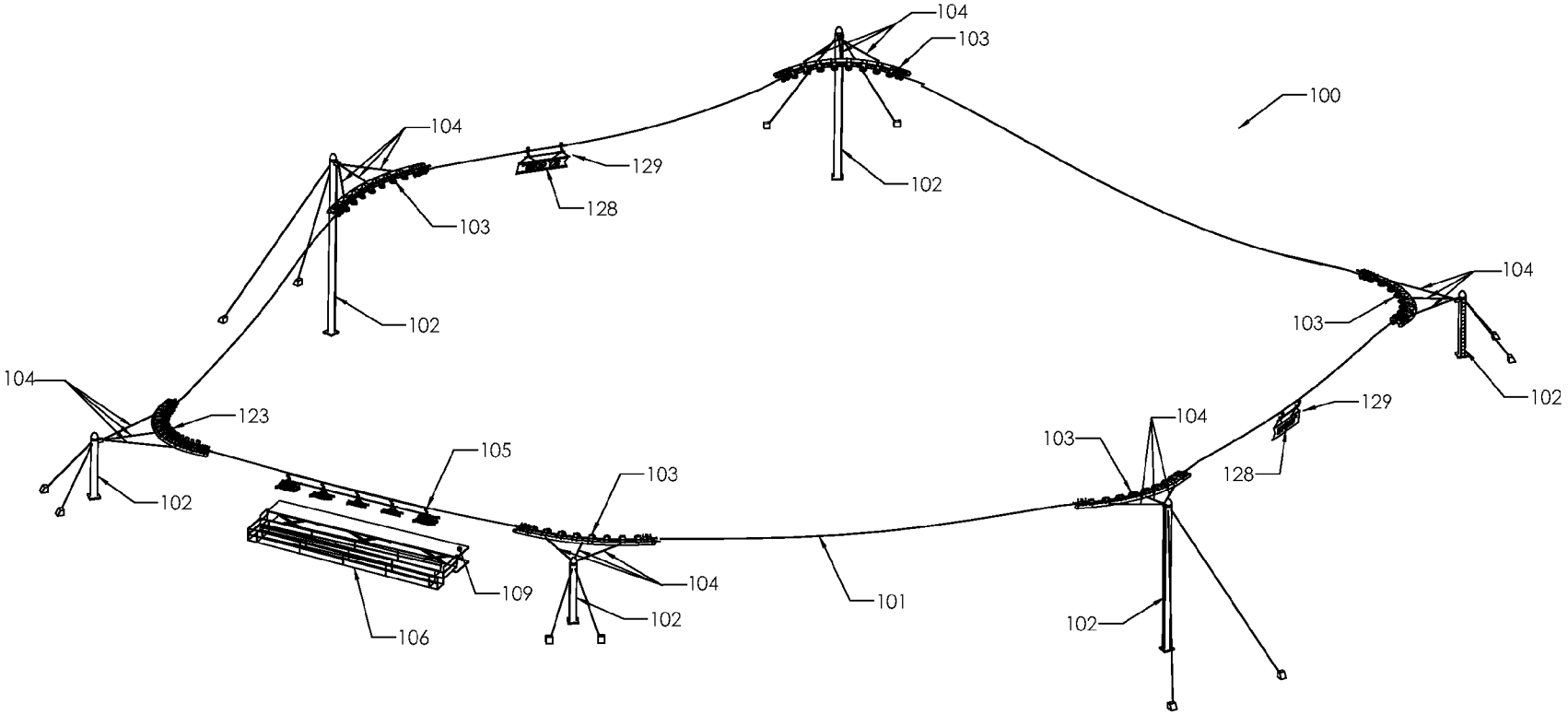
FIG. 1 is a top perspective view of the suspended rider cable lift.

FIG. 1 is a top perspective view of a suspended rider cable lift 100. A cable 101 is suspended in the air from towers 102. The cable 101 is a continuous loop that can be between 150 meters and 7600 meters long. The real limit on the length of the cable 101 is the strength of the cable and not any limitations on the other elements of the ride. In the depicted embodiment the loop is about 480 meters long. The towers can vary in height between 6 and -60 meters tall. In the depicted embodiment the towers range in height between 6 meters and 20 meters. The cable 101 is supported and guided by turning beam assemblies 103 attached to the towers 102 by suspension cables 104. Riders R are carried on a flyer train 105 in a generally front down orientation in the depicted embodiment. If desired the riders could be sitting in a seat or swing type device (not shown). In order to make it easier to load the riders on flyer train 105, it may be desirable to have two towers 102 be shorter than the other towers 102 to bring the flyer train 105 closer the ground at loading area 106. In some installations, this may not be desired. Maximum distance between the towers is dependent on the height of the towers and the terrain.

Power for the driving of the cable, and therefore the ride, is provided by turning beam drive assembly 123. In the depicted embodiment, the turning beam drive assembly 123 is located on the tower 102 directly in front of the loading area. It is not necessary that the turning beam drive assembly 123 is located next to the loading area 106; it could be located anywhere on the route of the ride. In installations with a longer cable 101 or with large changes in elevation, it may be desirable to have more than one turning beam drive assembly 123. If more than one turning beam drive assembly 123 is used, then there would need to be a means of synchronizing the control of the turning beam drive assemblies 123 to each other so that the cable 101 is not put under too much strain. The turning beam assembly 103 can be configured to turn the cable 101 between 0 to 180 degrees or any specific degree of turn in between. Using the turning beam of the present disclosure it is possible to turn the cable 101 any chosen amount between 0 and 180 degrees, unlike with standard bull wheel type rides. As seen in FIG. 1, a range of height of the towers 102 and a number of turning beam assemblies 103 with differing degrees of turn can be used to lay out different shaped and sized ride paths and to clear obstacles.

Figure 14:
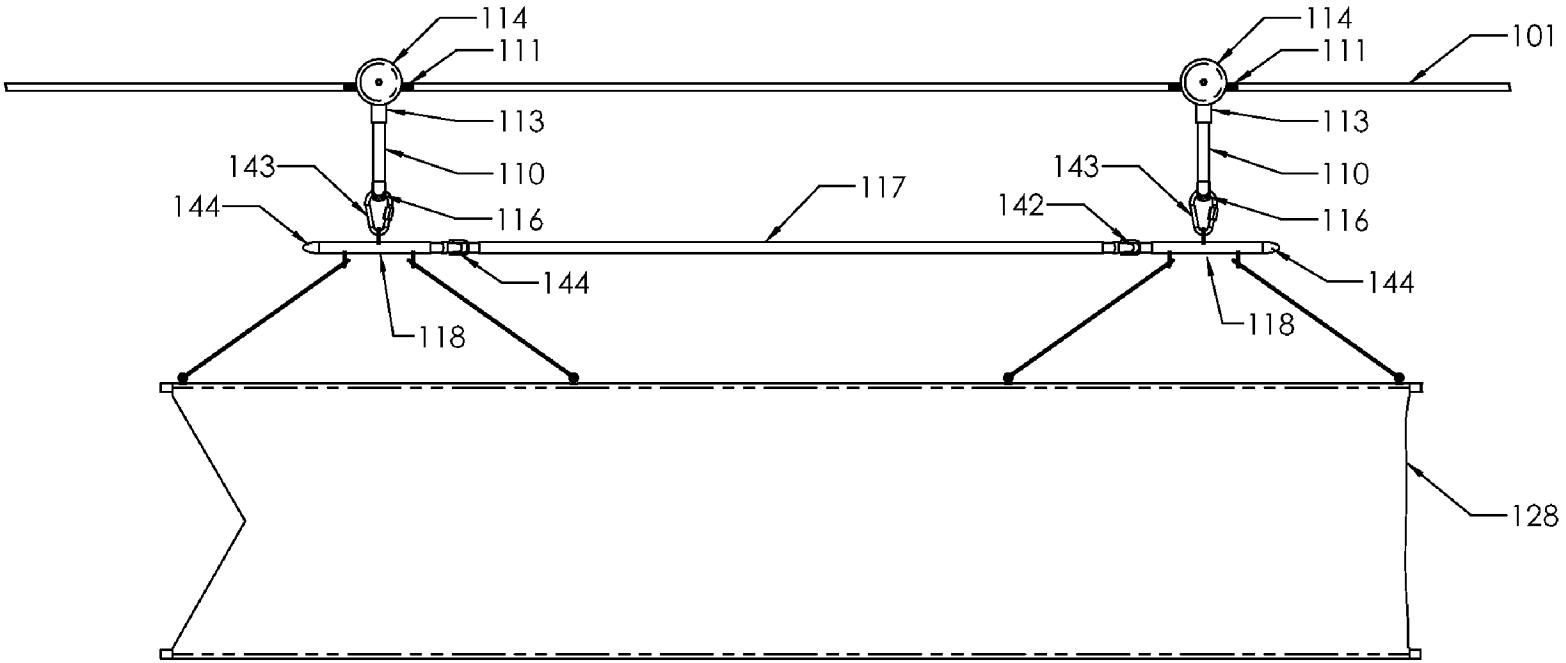
FIG. 14 is a side elevation view of a train with a banner.

If desired a second train 129 could be provided on the opposite side of the cable loop from the rider train 105 to counter balance the weight. The train 129 could carry a banner 128 that advertises the ride, or any other announcement desired by the operator of the ride. The banner 128 could be a fabric type device, a rigid sign or electronic display device, as desired, as shown in FIG. 14.

Figure 2:
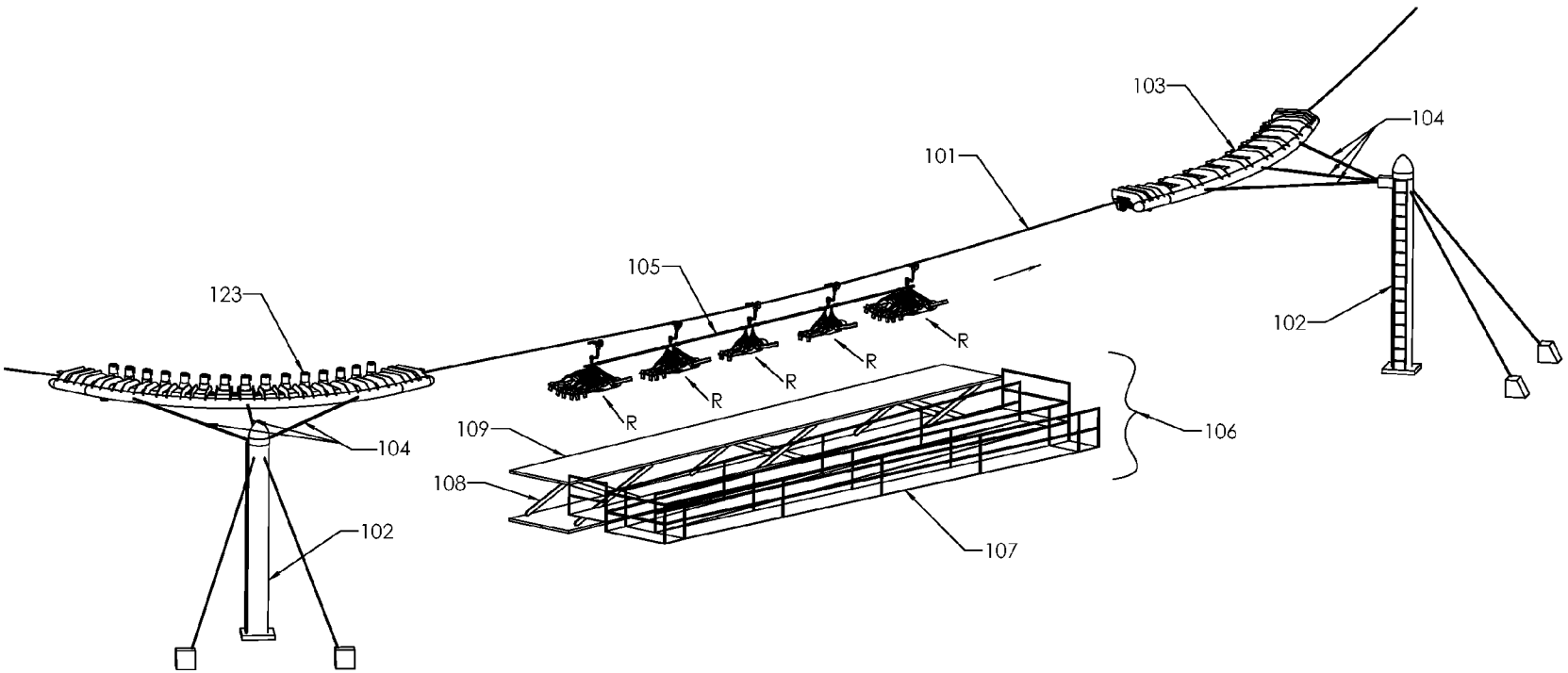
FIG. 2 is a top perspective view of the rider loading/unloading area.

FIG. 2 is a perspective view of one embodiment of a loading area 106. A queue guide 107 is provided to organize and guide the line of people waiting to ride on the suspended rider cable lift 100. The design of such queue guides 107 to ensure safety and minimize customer dissatisfaction with wait times is well known and will not be further discussed here. In the disclosed embodiment the queue guide 107 leads to a hydraulic scissor lift 108 to lower and lift a loading platform 109 with riders R on it up to be loaded on to the rider train 105 of the suspended rider cable lift 100. The hydraulic scissor lift 108 can then be lowered out of the way to ensure the riders R can be moved without hitting the loading platform 109. The use of the lifting loading platform 109 ensures that the riders R are always well clear of the ground when the ride is moving. Other methods of lifting the loading platform 109 can be used as well. Also, other methods of designing a loading platform 109 to allow the riders R to be loaded on the rider train 105 and then have the loading platform 109 move out of the way are possible as well and are considered within the scope of this disclosure.

Figure 3:
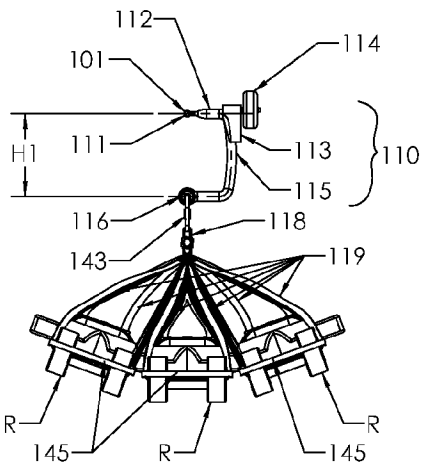
FIG. 3 is a side elevation view of a grip hanger and riders.

FIG. 3 is a side elevation view of a hanger 110 that forms the attachment of the rider train 105 to the cable 101 and is the attachment location for the rigging for the riders R. The hangers 110 are fixedly attached to the cable 101 via a T section 111 of arm 112 in by inserting the T section into the braided cable in a known manner in the depicted embodiment. The arm 112 is attached to housing 113. A guide wheel 114 is rotatably attached to the housing 113 on the opposite side from arm 112. A suspension arm 115 extends from the housing 113 to below the cable 101. An attachment location 116 is at the bottom of the suspension arm 115. The hanger 110 is designed so that the attachment location is directly aligned with the T section 111 and the cable 101 to prevent the weight of the rider R from rotating the cable 101. When the ride is at rest, this places the attachment location 116 is directly below the cable 101, as seen in FIG. 3. Some swaying would be expected during use. The suspension arm 115 is bowed out to ensure that the hanger 110 does not come into contact with the sheave wheels discussed below. The exact amount of bowing will depend on the particular application in use. No limitation to the depicted embodiment should be inferred. In the disclosed embodiment the hanger 110 is forged steel, with T section 111, arm 112 and suspension arm 115 all being formed from a single piece of forged steel and the housing 113 being forged onto the single piece, however any material and/or manufacturing method with the necessary material characteristics could be used as well. The hanger 110 has a height H1 from T section 111 to attachment location 116. In the depicted embodiment H1 is 84 cm, however other sizes will work as well, as long as the a hanger 110 is long enough to ensure that none of the rider rigging or the bodies of the riders could get caught up in the turning beam assembly 103 and the turning beam drive assemblies 123.

Figure 5:
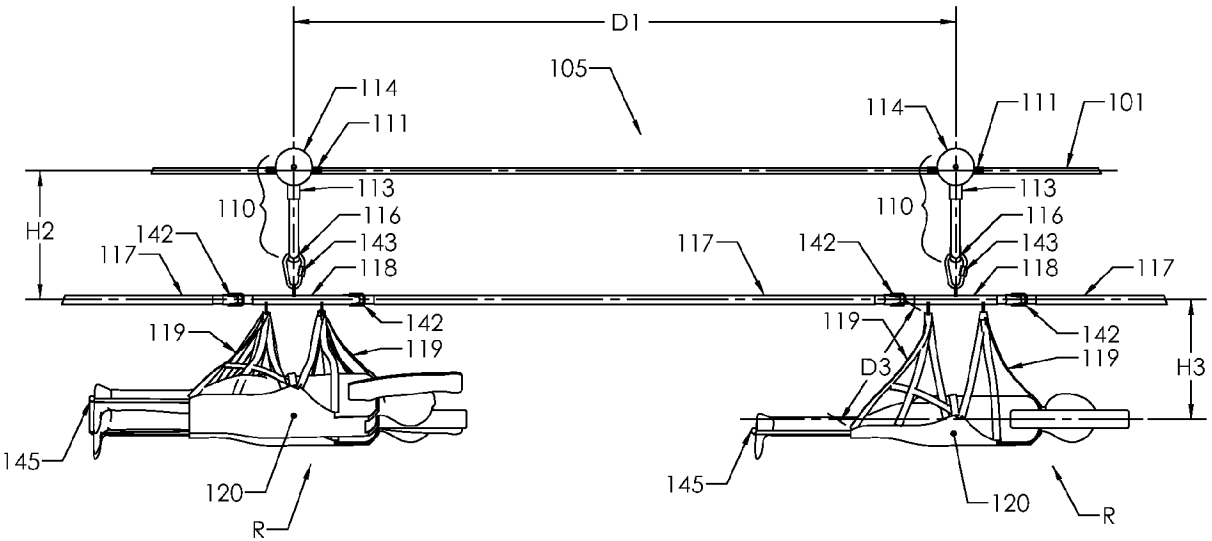
FIG. 5 is a side elevation view of a segment of the rider train.
Figure 4:
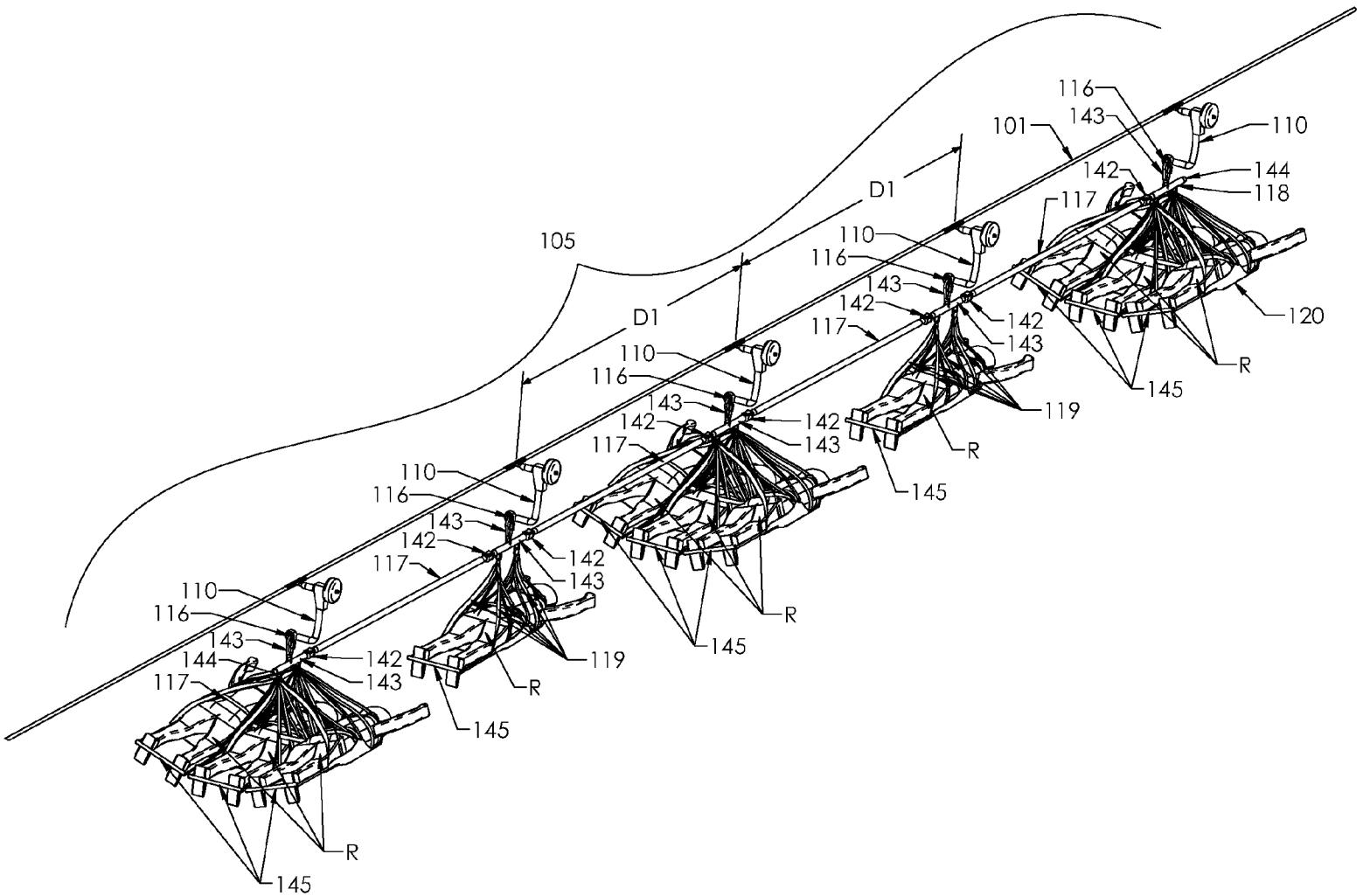
FIG. 4 is a top perspective view of a rider train.

Referring next to FIGS. 4 and 5, a rider train 105 supports the riders R on the hangers 110. Multiple hangers 110 are attached to the cable 101*a* given distance D1 apart. In the depicted embodiment D1 is about 3.7 meters to ensure that the riders R cannot come into contact with each other. Other distances could be used as well, so long as safety considerations are met. Rider supports 117 are attached to the attachment location 116 of the hanger 110 and have a length of D2. D2 is 1.8 meters in the depicted embodiment. In the depicted embodiment rider supports 117 are substantially rigid rods. Stiff cables and other material could be used as well. The rider supports 117 function to reduce any forward and backward (relative to the direction of travel of the rider R) sway of the rider R and to tie the riders R in the rider train 105 together to prevent to much strain on the cable 101 being caused by each rider R being able to sway individually when the riders R are coming out of a turn.

A platform 118 is suspended between two hangers 110 by rider supports 117 at height H2 from the attachment location 116 to the center line of the platform 118. H2 is about 60 cm in the depicted embodiment. If desired, the platform 118 can have extra mass to act as a counterweight to further dampen the motion of the riders R. This attachment to two hangers 110 provides both additional safety and allows for the damping effects described herein. The length of the rider supports 117 is determined by the distance D1 between the hangers 110 and the desired sway of the riders R. The longer D2 is for a given distance D1, the larger height H2 is and the more sway that is experienced by the riders R. Riders R are attached at height H3 below the platform 118 on straps 119 attached to a flight suit 120 at least two locations at the neck and base of the spine of the rider R to prevent twisting of the rider R. In the depicted embodiment straps 119 are made of webbing. H3 is about 60 cm in the depicted embodiment. Height H3 can be varied as well to increase or decrease the amount of sway that the riders R can experience. The flight suits 120 in the depicted embodiment are a modified hang gliding suit with the two attachment locations, such as are used on Skycoaster® amusement rides and other similar flight rides. Between one to three riders R can be attached to a platform 118. For safety reasons, it is probably desirable to make it difficult for the riders to detach themselves from straps 119. This could be done in a number of ways, including locking attachments or other means known in the art. The entire rigging from the attachment point 116 downward acts in a manner to control the sway of the rider R. This limits the sway of the riders R to a safe level. The rigging could be used to suspend a rider beneath a standard roller coaster rider carriage if desired for an additional type of amusement ride.

Figure 6:
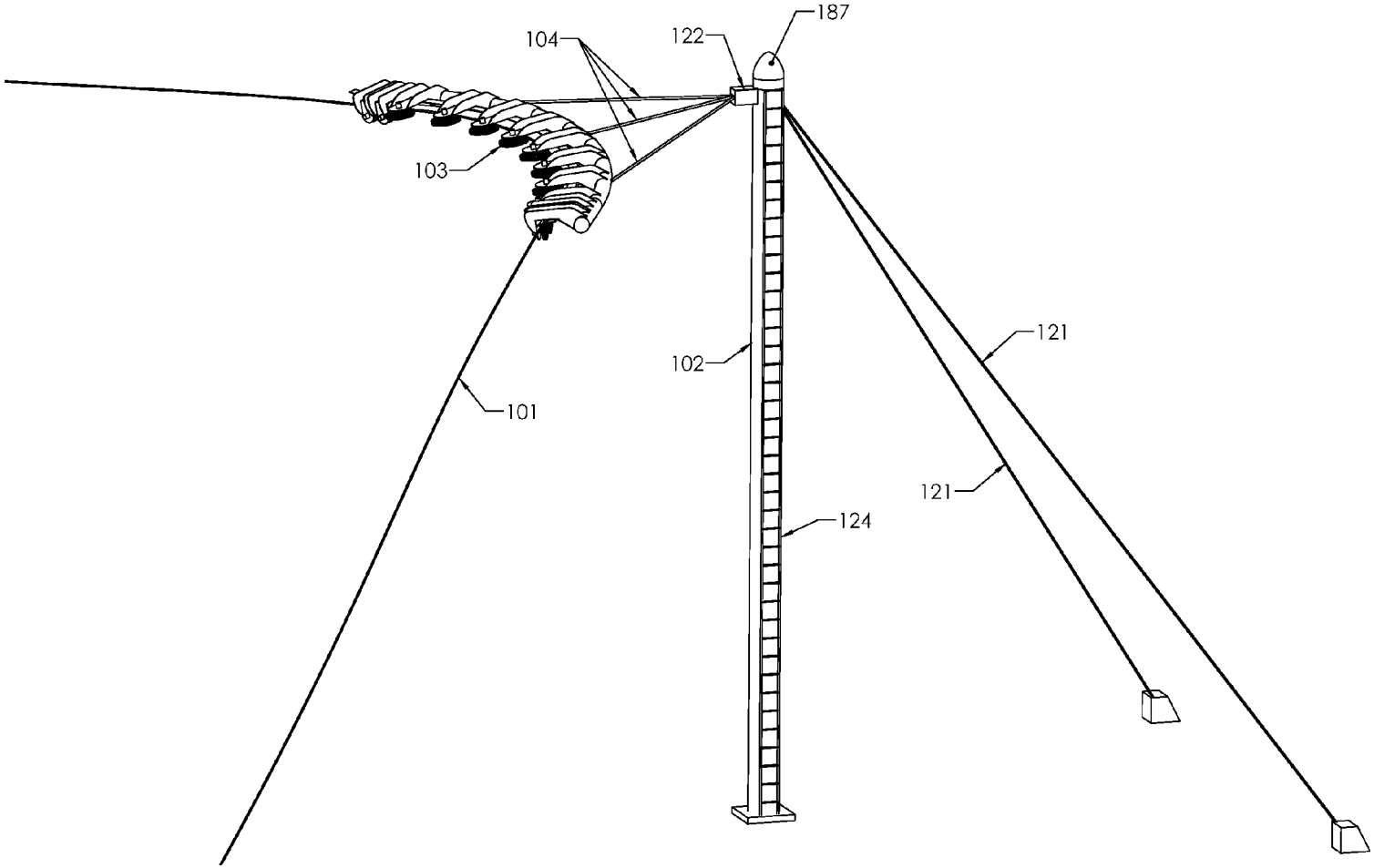
FIG. 6 is a perspective view of a suspension tower with a turning beam assembly.

The cable 101 is held in the air by towers 102, as shown in FIG. 6. The towers 102 are anchored and stabilized by stabilizing cables 121 to hold the towers 102 vertical against the weight and tension of the cable 101 and the forces generated by the operation of the ride. The tower 102 has a tension jack screw assembly 122 mounted near the top of the tower 102. Access ladders 124 are provided to allow for maintenance. Tension cables 104 are attached to a turning beam assembly 103 which support and turn the cable 101. The tension cables 104 also function to ensure that the turning beam assemblies 103 and turning beam drive assemblies 123 are at a safe distance from the towers 102 such that the riders R or other parts of the ride do not come into contact with the towers 102 in operation. In the depicted embodiment the turning beam assemblies 103 and the turning beam drive assemblies 123 are about 5 meters from the towers 102. The horizontal tension between the towers and the cable loop tensions the entire system, like stretching a rubber band with the fingers of both hands. Not only does this provide stiffness to the entire system, but the jack screws then provide a simple, economical way to tension the cable.

Figure 7:
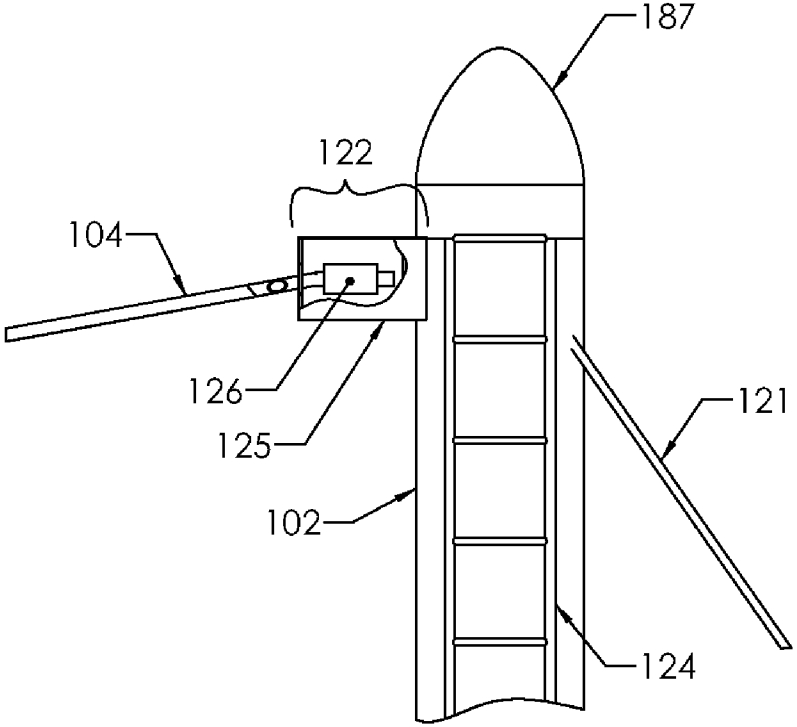
FIG. 7 is a cut away of the tension screw assembly.

FIG. 7 is a cut away view of the tension jack screw assembly 122. The tension cables 104 are attached to the jack screw 126 inside housing 125. The jack screw 126 allows ride operators to shorten the tension cables 104, thereby tightening cable 101 to compensate for stretch of the cable 101 over time. In some installations an automatic system to adjust the length of the tension cables 104 could be used as well. The jack screws 106 also make installation of the cable 101 easier, as exact tolerances are not required. Cap 187 can be provided to provide a streamline appearance. If desired the tower 102 could extend farther up to allow for lights, signage or both.

Figure 8:
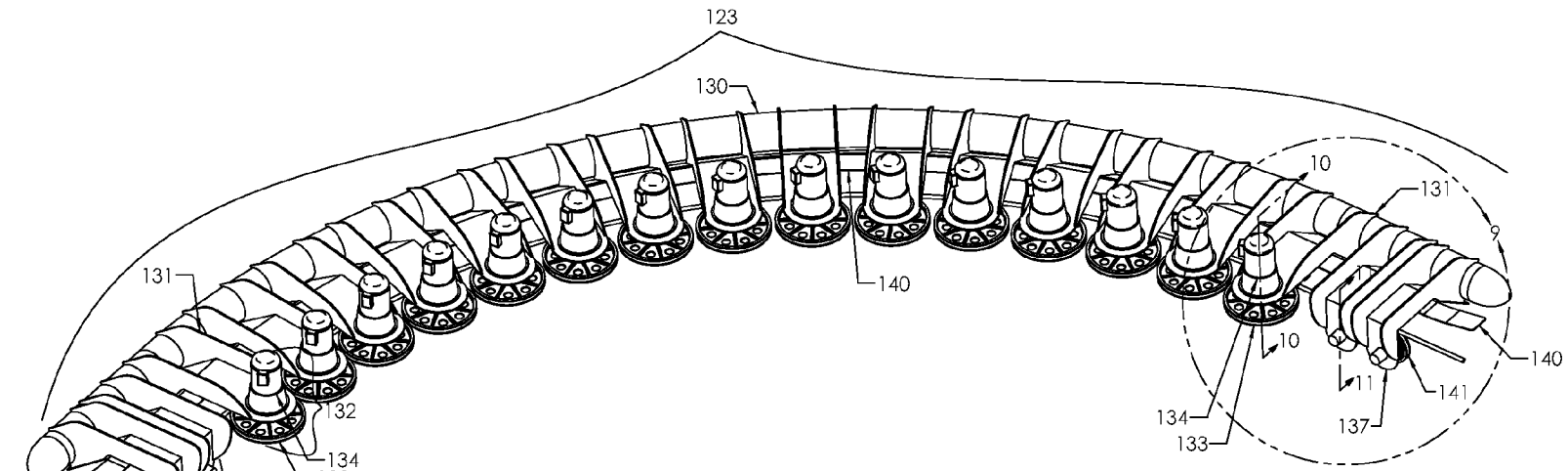
FIG. 8 is a top perspective view of a turning beam drive assembly.

A turning beam drive assembly 123 with a 90 degree turn in the direction of travel of the cable is seen in FIG. 8. The cable approaching the turning beam drive assembly and the cable departing therefrom together define a first plane associated with the turning beam drive assembly. A turning beam 130 is the spine of the turning beam drive assembly 123. Brackets 131 are mounted along the inner curve of the bend of the turning beam 130. The length of the turning beam 130 is determined by the speed of the ride and the degree of turn desired. The faster the cable 101 is traveling at maximum speed, the more gradual any turn has to be, therefore the longer the turning beam 130 needs to be. The brackets 131 hold sheave drive assemblies 132. Each sheave drive assembly 132 has a sheave wheel 133 and a motor 134 to drive the sheave wheel 133 in the depicted embodiment. It is not necessary that every sheave wheel 133 be driven by a motor 134 in order for the turning beam drive assembly 123 to function. In the depicted embodiment, a 3 horsepower motor is used. In the depicted embodiment the sheave wheel has a 56 cm diameter and there are 15 sheave drive assemblies 132.

Figure 10:
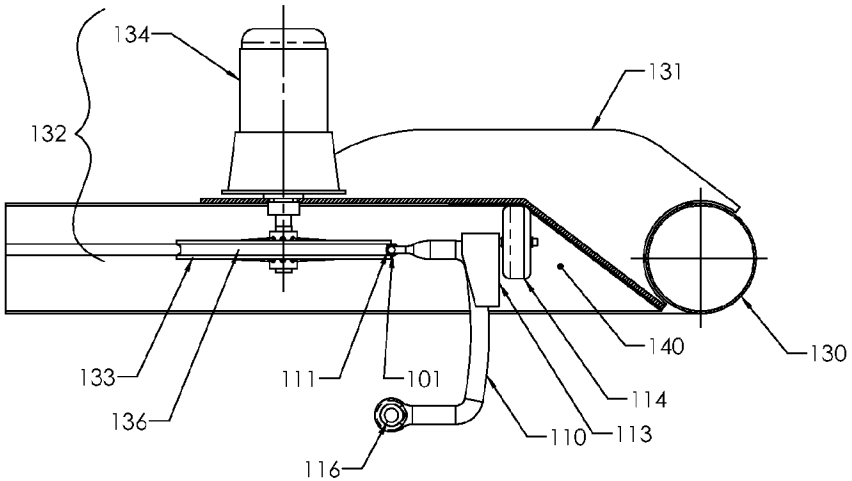
FIG. 10 is a cut away of the sheave drive assembly taken along line 10-10 of FIG. 8.

References to horizontal and vertical refer the orientation as shown in FIG. 10. No limitation should be inferred from the use of the terms horizontal or vertical in describing elements of the turning beams. In use the turning beam drive assembly 123 may be at an angle from horizontal due to the pull of the cables and the forces involved in the operation of the ride. With the sheave wheel 133 of the depicted embodiment 6 degrees of turn per sheave wheel 133 is obtained. For the turning beam drive assembly 123 to function well about at least a 90 degree turn is desired to ensure there is sufficient friction on the cable 101. A lower degree of turn may result in slippage of the sheave wheels 133 along cable 101. The turning beam drive assembly 123 can have an up to 180 degree of turn.

The small size of the sheave wheels 133 allows the sheave wheels 133 turn at a higher rotational velocity as compared with a traditional single bull wheel. The number of smaller sheave wheels 133 also allows multiple smaller motors to be used, rather than the very large motors required with traditional bull wheels. The small sheave wheels 133 also allow the ride to be stopped and started without using the large amounts of energy required to start or stop the huge inertia of large bull wheels of a traditional cable supported ride. The combination of the small motors 134 with the small sheave wheels 133 means that complicated gearing and/or transmissions are not needed. The motor 134 can be attached with a smaller gear assembly to the sheave wheel 133. Also, the failure of a single motor 134, or even multiple motors 134, would not cause the ride 100 to cease all operation. This would allow the riders R to be moved to the loading platform 106 to be removed from the ride 101 without the need for ladders or other evacuation methods used when standard cable rides fail. Also, this makes maintenance and replacement of worn parts much easier, as removing a single sheave wheel 133 would not require that the cable 101 be provided with supplemental support or to be disengaged from the other sheave wheels 133.

The depicted embodiment can reach speeds of up to 25 to 60 miles an hour (40.2 to 96.6 kilometers per hour). Based upon calculations, it is believed that riders R will experience G forces in the turns of up to 2.5 G's or more when the ride is going 40 mph (64.4 kph). All of the components of the ride will need to be chosen to withstand these forces for repeated operations of the ride.

Figure 9:
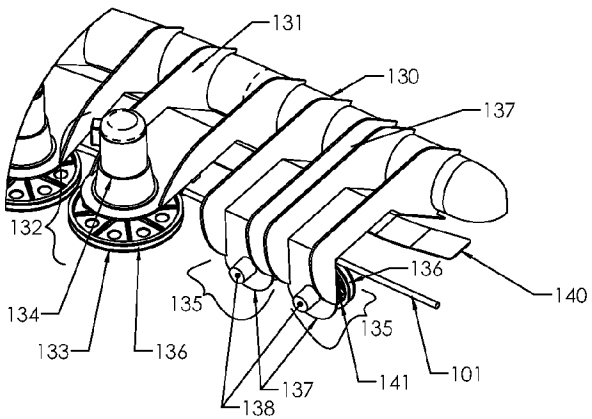
FIG. 9 is a detail view of the circle 9-9 of FIG. 8.
Figure 13:
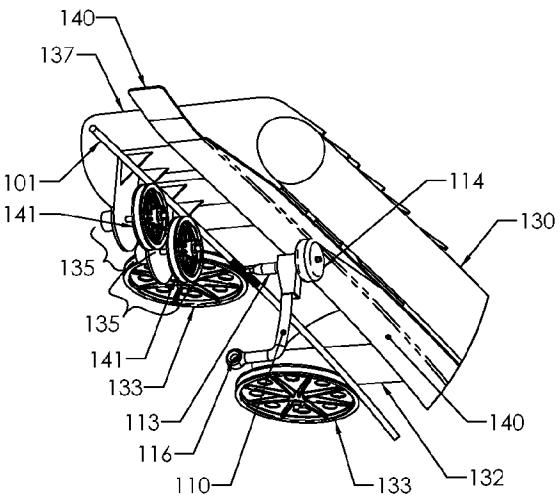
FIG. 13 is a bottom perspective view of a segment of a turning beam assembly.

FIG. 10 is a cross-section of a sheave drive assembly 132 taken along line 10-10 of FIG. 8. The sheave wheels 133 have a circumferential groove 136 into which cable 101 fits. The groove 136 needs to be deep and wide enough to prevent the cable 101 from slipping out of the groove 136. A guide flange 140 is mounted along the inner curve of turning beam 130 under the brackets 131, as also seen in FIGS. 9 and 13. The guide flange 140 is substantially parallel to the plane of the sheave wheel 133 in the depicted embodiment. The guide wheel 114 of the hanger 110 runs along the underside guide flange 140 as best seen in FIGS. 10 and 13. This prevents the hanger 110 from swaying out too much with the force of the turn due to centrifugal force. This keeps the attachment point 116 substantially under the cable 101 during turns. Only the rider supports 117, platform 118 and the straps 119 allow the rider R to sway from side to side in the depicted embodiments.

Figure 11:
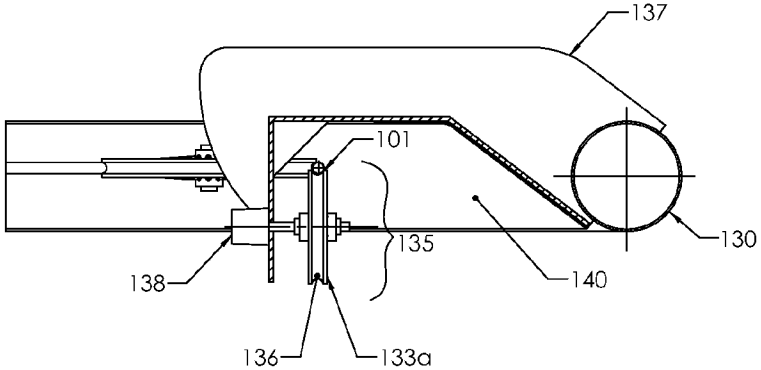
FIG. 11 is a cross sectional view of the supporting sheave assembly taken along line 11-11 of FIG. 8.

At each end of the turning beam assembly 103 and turning beam drive assembly 123 is a supporting sheave assembly 135, seen in FIGS. 8 and 9 and in a cross section in FIG. 11. The sheave drive assemblies 132 drive the cable 102 around the curve and the supporting sheave assemblies 135 hold the cable 101 up against gravity in the turning beam assembly 103 and the turning beam drive assemblies 123. The supporting sheave assembly 135 is held by bracket 137. The supporting sheave wheel **133*a* is substantially vertical in relation to the ground. The supporting sheave wheel 133*a* is supporting the cable 101 against the majority of pull of gravity, so a significant deviation from vertical is not possible. The exact amount of deviation from vertical of the supporting sheave wheel 133*a* will depend on the depth of the groove 136 and the speed of the ride in operation. The supporting sheave wheel 133*a* is mounted to the bracket 137 with thrust bearing 138**.

Figure 12:
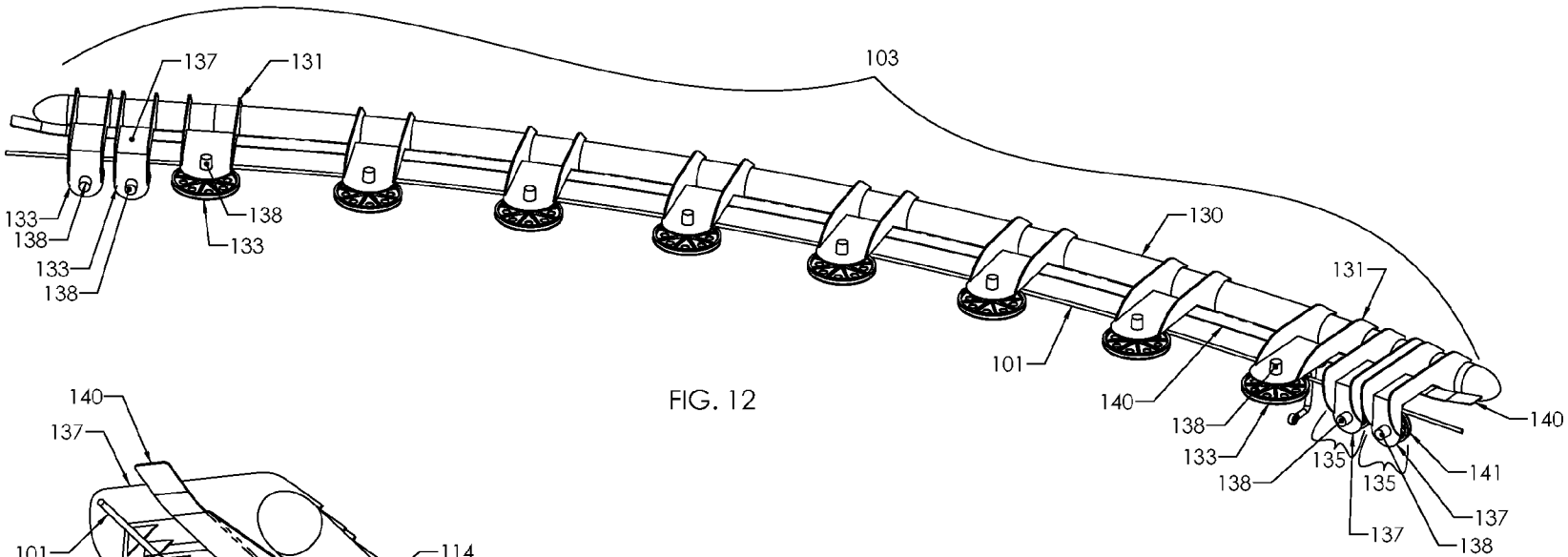
FIG. 12 is a top perspective view of a turning beam assembly.

FIG. 12 is a turning beam assembly 103 with a 48 degree turn. In the turning beam assembly 103 there are no motors. The cable 101 is guided by the turning beam assembly 103 through a desired degree of turn in the direction of the travel of the cable while the cable 101 is supported in the air. The turning beam assembly 103 has brackets 131 and sheave wheels 133, however thrust bearings 138 hold the sheave wheels 133 in the bracket 131 instead of motors 134. The turning beam assembly 103 has guide flange 140 for the stabilization of the hanger 110 as with the turning beam drive assembly 123. A lower degree of turn allows the brackets 131 to be spaced farther apart in the depicted embodiment. A turning beam assembly 103 can have any desired degree of turn up to 180 degrees. All of the turning beam assemblies 103 and the turning beam drive assemblies 123 on a given ride will have to turn the same direction, as otherwise the hanger 110 will run into the sheave wheels 133. However, a given ride could turn either all to the left, as depicted, or all to the right.

When the ride is installed is it necessary to ensure that the end of each turning beam 130 is aligned with the end of the next turning beam assembly or turning beam drive assembly to ensure that the cable 101 does not slip off the sheave wheels 133. The turning beam 130 can also curve up to compensate for the catinary (dip) of the cable between beams. This would form a compound curve of the turning beam 133 to align with the catinary of the cable between beams. The degree of change between any two sheave wheels 133 will depend on the size of the sheave wheels 133 and the maximum speed the cable 101 is designed to be traveling at in a given embodiment. The degrees of change between sheave wheels 133 are limited by the need for cable 101 to stay in the circumferential groove 136 and the strain on the cable 101. Too much of a difference between the plane of any two adjacent sheave wheels 133 would cause the cable 101 large amounts of strain, which would necessitate more frequent replacement of the cable 101.

Figure 15:
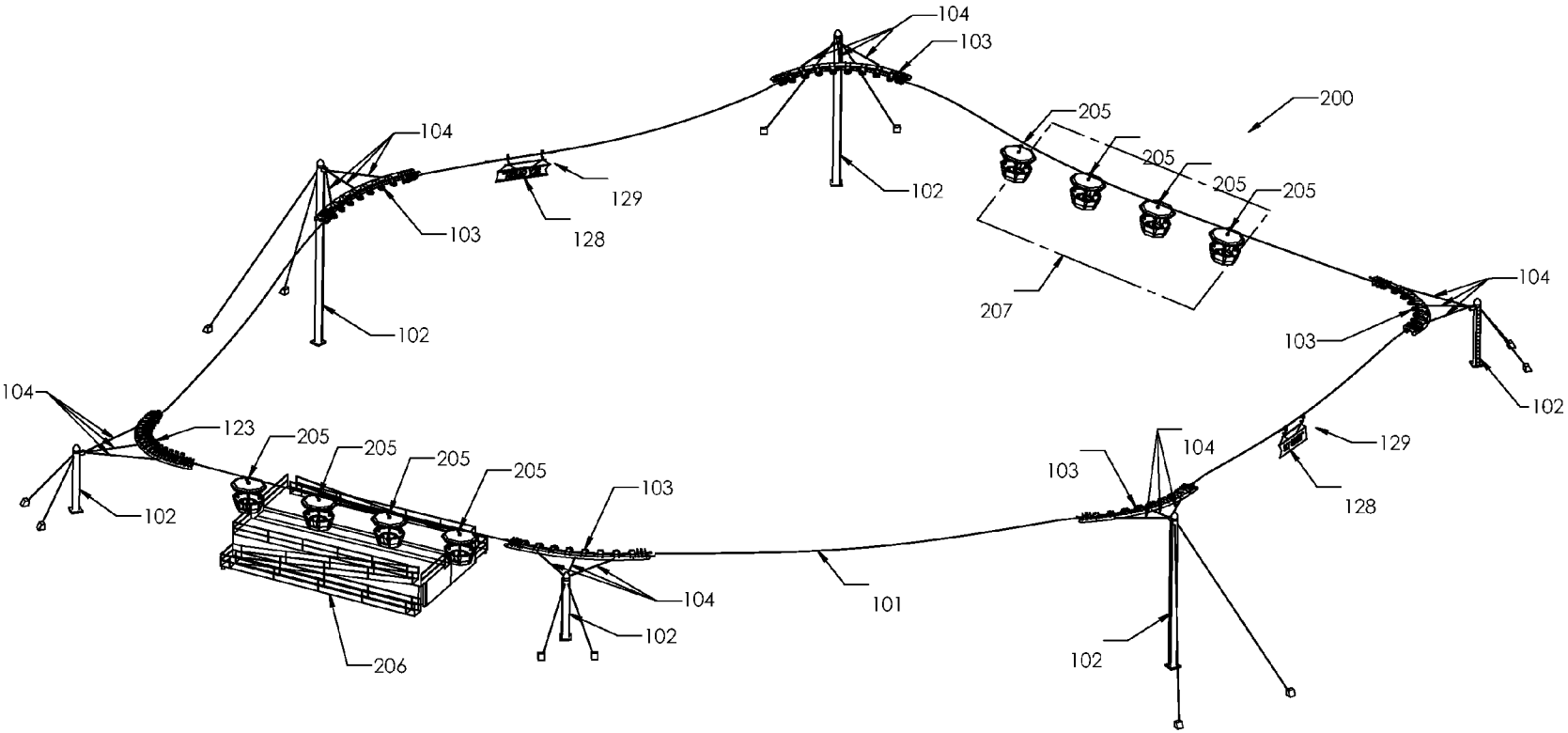
FIG. 15 is a top perspective view of a second embodiment of the ride.

FIG. 15 is a perspective view of a rider carriage embodiment for the suspended cable amusement ride 200. The flexibility of the layout of the cable 101 that is allowed by the towers 102, turning beam drive assembly 123, and turning beam assemblies 103 could be desirable in more standard cable lift uses, such as ski lifts, aerial viewing rides, people movers or similar types of rides. A rider carriage 205 would be used instead of suspending the riders R as in the other embodiment. A loading platform 206 would be provided to allow the riders R to come up to the level of the rider carriage 205, or the cable 101 could dip low enough that this is not necessary. The cable could either be moving slow enough (1.6-2.4 kilometer per hour) that riders could walk on to the slowing moving rider carriage 205 and then a ride operator would close and lock door 188 or the cable 101 could be stopped and the ride loaded and unloaded as above. The design of the turning beam drive assembly 123 allows the cable to be easily stopped and started, unlike with standard bull wheel type cable lifts.

Figure 16:
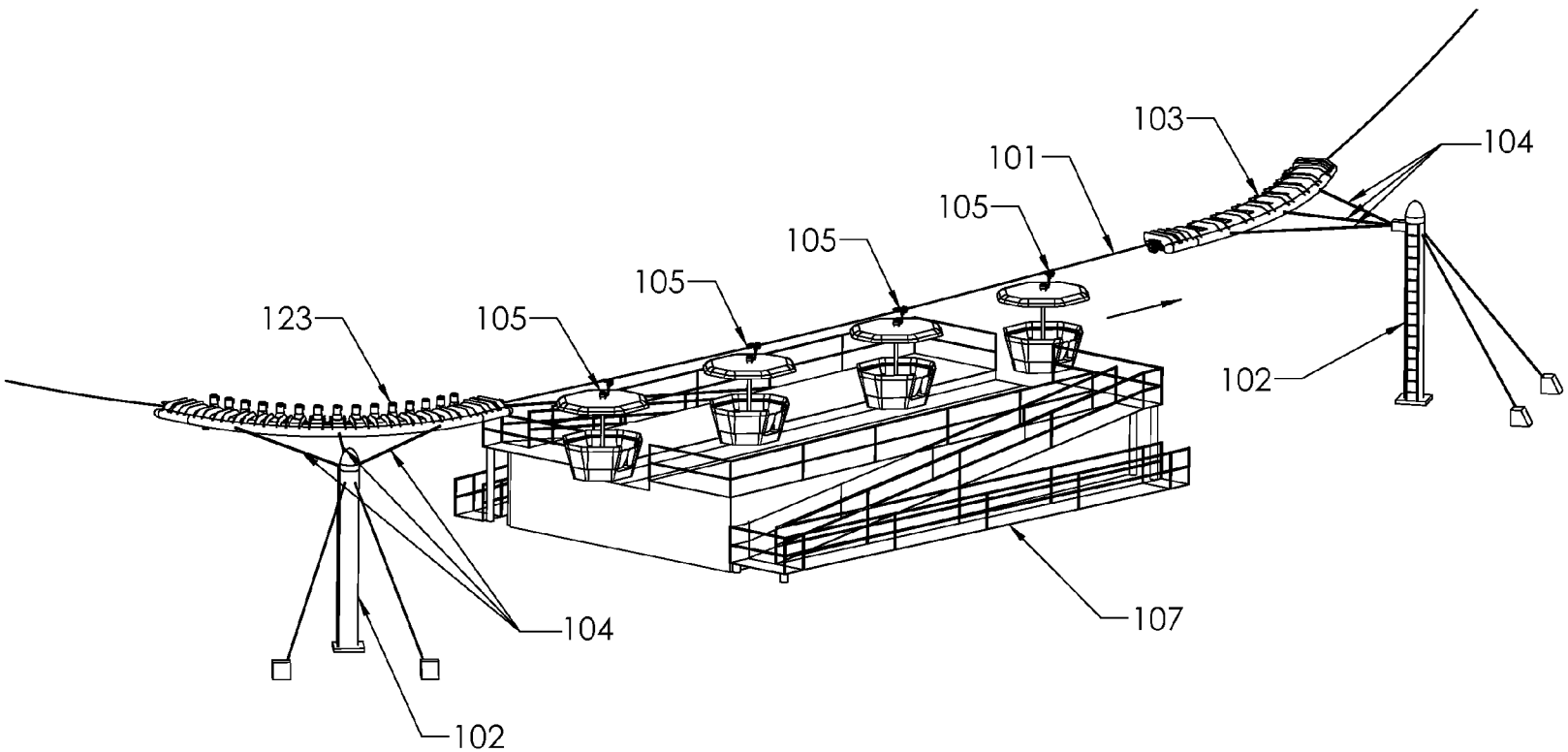
FIG. 16 is a top perspective view of the loading area of the second embodiment.

FIG. 16 is a close-up of the loading platform 206 with entrance and exit ramps 208 allowing the riders to load and unload on opposite sides of the platform as is well known in the amusement ride art.

Figure 17:
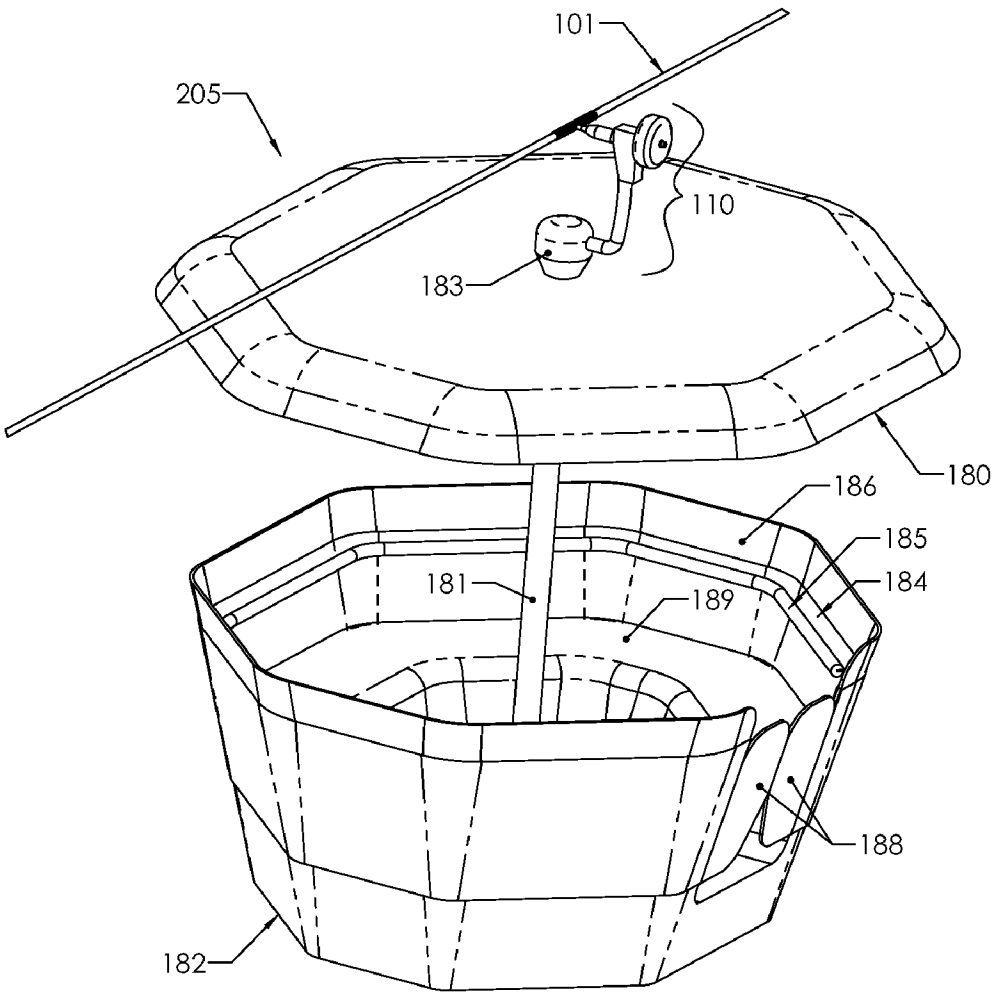
FIG. 17 is a top perspective view of the rider carriage.
Figure 19:
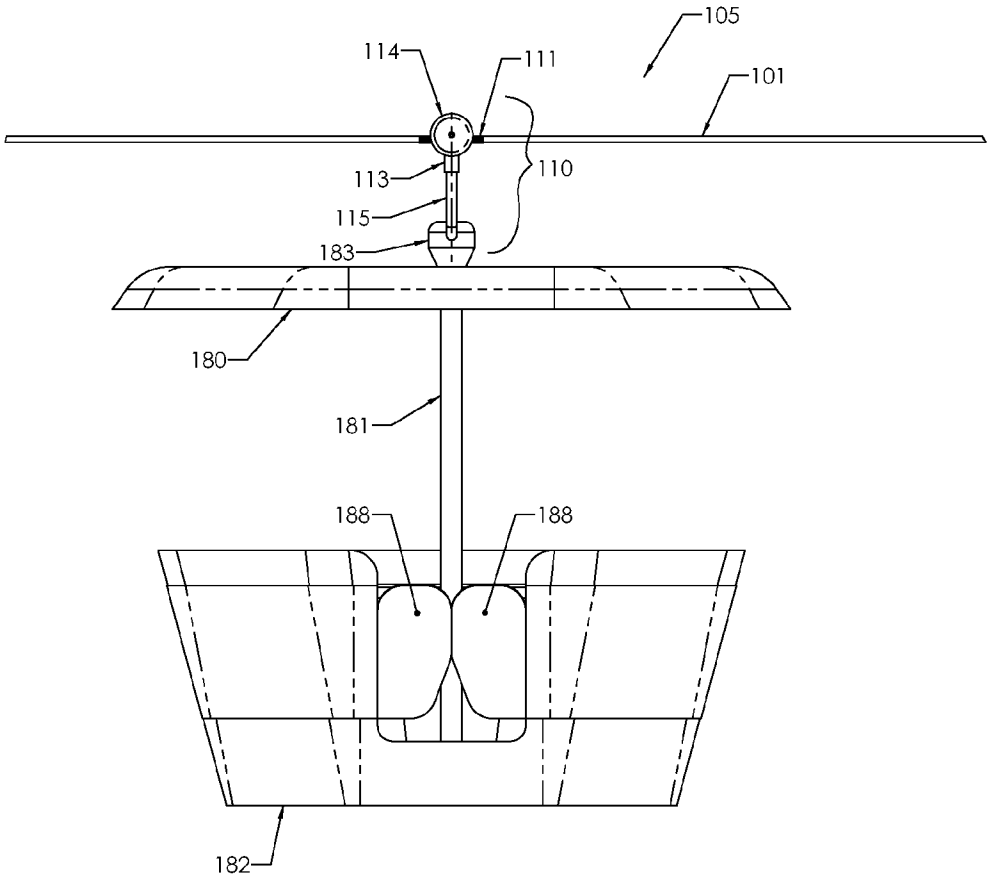
FIG. 19 is a side elevation view of the rider carriage.
Figure 18:
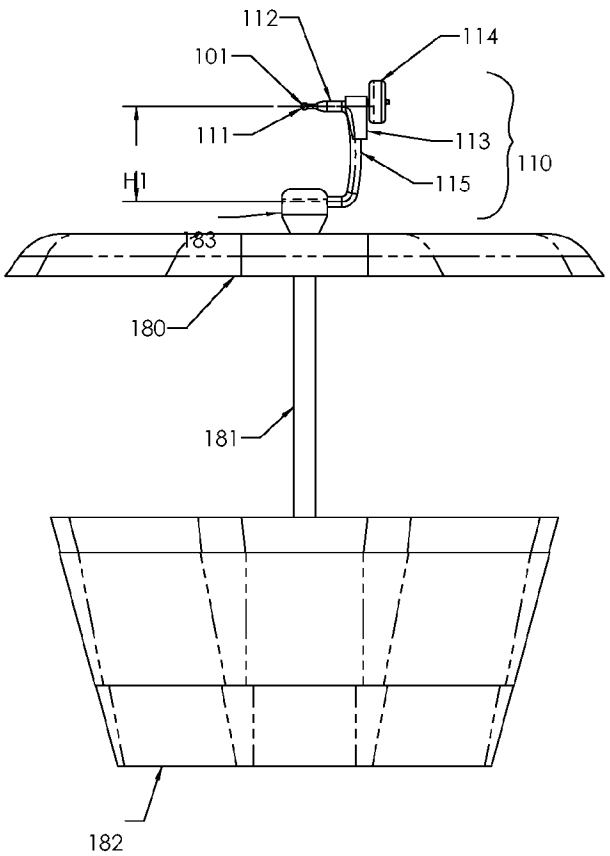
FIG. 18 is a side elevation view of the rider carriage.

Referring next to FIGS. 17, 18 and 19 the rider carriage 205 is attached to the hanger 110, which is identical to the hanger 110 used in the above embodiment. In some applications a different type of hanger 110 may be desired. The guide wheel 114 may not be needed in all applications if the ride 200 never moves with enough speed to cause the carriage to sway out, but the guide wheel may be desired to prevent wind and/or rider movement from causing too much sway in the turns. The hanger 110 attaches at the center of the top 180 of the rider carriage 205. It is necessary that the hanger 110 be attached such that the rider carriage 205 hangs level when it is empty/still.

The rider carriage 205 has a base 182 attached to center poll 181. Center pole 181 has top 183 which attaches to hanger 110. The rider carriage 205 has wall 186 with doors 188, benches 189 around a center pole 181 in the depicted embodiment. It is to be understood that other rider carriage designs could be used with the ride 200. Also, if desired, the type of rider carriage that detaches from the cable 101 at the loading and unloading station could be used with some modifications to the system.

If desired a second loading and unloading station 207 could be provided to allow the ride 200 to be used to transport people between two locations as seen in FIG. 15.

The above device can be described as a method for use with a cable passing by a sheave assembly having a plurality of sheave wheels disposed in a sequence, a first sheave wheel being substantially coplanar with the cable as it approaches the assembly and a final sheave wheel in the sequence being substantially co-planar with the cable as it departs from the assembly, the cable having a load attached thereto at a point by means of a hanger, the method comprising the steps of:

passing the point by a first sheave wheel in the sequence;

passing the point by successive sheave wheels in the sequence;

passing the point by a last sheave wheel in the sequence;

whereby the point passes around a curve and is urged outward by centrifugal force;

wherein the hanger, during the passing steps, is blocked by a guide flange from moving outward in response to the centrifugal force.

The method of above wherein at least two of the sheave wheels are driven each by a respective motor. The method of above wherein the hanger supports a rigging carrying a human passenger, and wherein the rigging, during the passing steps, moves outward in response to the centrifugal force.

A method for use with a looped cable passing by a plurality of sheave assemblies, each sheave assembly having a respective plurality of sheave wheels disposed in a sequence, the sheave wheels of any particular one of the assemblies substantially coplanar with the cable as it approaches the particular one of the assemblies and with the cable as it departs from the particular one of the assemblies, the cable having a load attached thereto at a point by means of a hanger, the method comprising the steps of:

for each of the plurality of sheave assemblies, passing the point by a first sheave wheel in the sequence;

passing the point by successive sheave wheels in the sequence;

passing the point by a last sheave wheel in the sequence;

whereby the point passes around a curve and is urged outward by centrifugal force;

wherein the hanger, during the passing steps, is blocked by a guide flange from moving outward in response to the centrifugal force.

The method of above wherein on at least one of the sheave assemblies, at least two of the sheave wheels are driven each by a respective motor. The method of above wherein the hanger supports a rigging carrying a human passenger, and wherein the rigging, during the passing steps, moves outward in response to the centrifugal force.

While a number of exemplary aspects and embodiments have been discussed above, those of skill in the art will recognize certain modifications, permutations, additions and sub-combinations therefor. It is therefore intended that the following appended claims hereinafter introduced are interpreted to include all such modifications, permutations, additions and sub-combinations are within their true sprit and scope. Each apparatus embodiment described herein has numerous equivalents.

The terms and expressions which have been employed are used as terms of description and not of limitation, and there is no intention in the use of such terms and expressions to exclude any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given, are intended to be included in the disclosure.

In general the terms and phrases used herein have their art-recognized meaning, which can be found by reference to standard texts, journal references and contexts known to those skilled in the art. The above definitions are provided to clarify their specific use in the context of the invention.

I claim:

1. A suspended cable ride comprising:

a loop of cable;

at least two towers;

a turning beam drive assembly having a spine supporting at least three sheave wheels functioning to drive the cable at a desired speed around the loop;

at least two of the sheave wheels on the turning beam drive assembly being powered by motors;

at each end of the spine the turning beam drive assembly having an end sheave wheel attached at a substantially right angle to a plane of at least one of the sheave wheels, said end sheave wheels supporting the cable against gravity;

a turning beam assembly having a spine supporting at least three sheave wheels;

at each end of the spine the turning beam assembly having an end sheave wheel attached at a substantially right angle to the plane of at least one of the sheave wheels powered by motors, said end sheave wheels supporting the cable against gravity;

at least one of the towers having a turning beam drive assembly attached to the tower at a point above the ground;

the remaining towers having a turning beam assemblies attached to the tower at a point above the ground;

the turning beam drive assembly and the turning beam assemblies supporting the cable above the ground; and at least one rider conveyance for holding at least one rider attached to the cable.

2. The apparatus of claim 1 wherein the rider conveyance holds the rider in a generally front-down orientation.

3. The apparatus of claim 2 wherein the rider conveyance further comprises:

at least two hangers attached to the cable, each hanger having a rider attachment point located below the cable a distance H1;

the hangers being located a distance D1 apart on the cable;

at least one rider support attached to each rider attachment point;

a platform attached to two rider supports between two hangers at a distance H2 below the cable; and a rider attached to the platform by at least one strap such that the rider is a distance H3 below the platform.

4. The apparatus of claim 1 wherein the turning beam drive assembly further comprises a guide flange cooperating with the hanger to prevent the hanger from moving outward due to centrifugal force.

5. The apparatus of claim 4 wherein the hangers further comprises a wheel that runs along the guide flange.

6. The apparatus of claim 1 a majority of the sheave wheels are powered by motors.

7. The apparatus of claim 1 wherein the turning beam drive assemblies are attached to the tower by a plurality of cables.

8. The apparatus of claim 7 wherein the cables are attached to the tower by a tightening means functioning to allow the length of the cables to be adjusted add tension.

9. The apparatus of claim 8, wherein the tightening means is a jack screw.

10. The apparatus of claim 1 wherein the turning beam drive assembly turns in a direction of travel of the cable by about 90 degrees.

11. The apparatus of claim 10 wherein the turning beam assembly changes the direction of travel of the cable between 10 and 180 degrees.

12. The apparatus of claim 1 wherein the rider conveyance is a rider carriage which is capable of holding at least two riders.

13. The apparatus of claim 1 wherein the cable is driven at a speed of between 2 to 96 kilometers per hour.

14. An apparatus to suspend a rider beneath a moving point in a manner to dampen the motion experienced by the rider, the apparatus comprising:

at least two hangers attached to a means of moving the rider through the air, each hanger having a rider attachment point located a distance H1 below the means of moving the rider;

the hangers being located a distance D1 apart;

at least one rider support attached to each rider attachment point;

a platform attached to two rider supports between two hangers at a distance H2 below the cable, the distance H2 chosen such that the platform does not contact the hangers; and a rider suspended below the platform by at least one strap such that the rider is a distance H3 below the platform, the distance H3 chosen such that the riders do not contact the platform.

15. The apparatus of claim 14, wherein the means of moving the rider is a driven cable.

16. The apparatus of claim 14, wherein the rider is attached to the platform by two straps spaced apart on the rider.

17. The apparatus of claim 14 wherein the rider is in a generally front-down orientation.

18. A method of moving a person through the air comprising:

supporting a loop of cable at a chosen height above ground along a chosen path, the height being chosen to allow a person suspended beneath the cable to move along the chosen path without contacting the ground;

driving the cable such that a chosen point on the cable traverses the chosen path;

the cable being driven by a multiplicity of sheave wheels mounted on a single beam in an arc; and the cable being supported by supporting sheave wheels mounted approximately vertical in relation to the pull of gravity.

19. The method of claim 18 further comprising the steps of:

suspending a platform beneath the cable between two hangers attached to the cable;

suspending the person beneath the platform in a generally front down configuration.

20. The method of claim 18 further comprising the steps of providing a rider carriage capable of supporting at least two riders.

21. The method of claim 20 wherein the riders are seated.

22. A method for use with a cable passing by a sheave assembly having a plurality of sheave wheels disposed in a sequence, a first sheave wheel being substantially coplanar with the cable as it approaches the assembly and a final sheave wheel in the sequence being substantially co-planar with the cable as it departs from the assembly, the cable having a load attached thereto at a point by means of a hanger, the method comprising the steps of:

passing the point by a first sheave wheel in the sequence;

passing the point by successive sheave wheels in the sequence;

passing the point by a last sheave wheel in the sequence;

whereby the point passes around a curve and is urged outward by centrifugal force;

wherein the hanger, during the passing steps, is blocked by a guide flange from moving outward in response to the centrifugal force and wherein at least two of the sheave wheels are driven each by a respective motor.

23. The method of claim 22 wherein the hanger supports a rigging carrying a human passenger, and wherein the rigging, during the passing steps, moves outward in response to the centrifugal force.

24. A method for use with a looped cable passing by a plurality of sheave assemblies, each sheave assembly having a respective plurality of sheave wheels disposed in a sequence, the sheave wheels of any particular one of the assemblies substantially coplanar with the cable as it approaches the particular one of the assemblies and with the cable as it departs from the particular one of the assemblies, the cable having a load attached thereto at a point by means of a hanger, the method comprising the steps of:

for each of the plurality of sheave assemblies, passing the point by a first sheave wheel in the sequence;

passing the point by successive sheave wheels in the sequence;

passing the point by a last sheave wheel in the sequence;

whereby the point passes around a curve and is urged outward by centrifugal force;

wherein the hanger, during the passing steps, is blocked by a guide flange from moving outward in response to the centrifugal force and wherein on at least one of the sheave assemblies, at least two of the sheave wheels are driven each by a respective motor.

25. The method of claim 24 wherein the hanger supports a rigging carrying a human passenger, and wherein the rigging, during the passing steps, moves outward in response to the centrifugal force.

26. A drive system for a suspended cable comprising:

a turning beam drive assembly having a spine supporting at least three sheave wheels functioning to drive the cable at a desired speed;

at least two of the sheave wheels on the turning beam drive assembly being powered by motors; and at each end of the spine the turning beam drive assembly having an end sheave wheel attached at a substantially right angle to the plane of at least one of the sheave wheels powered by motors, said end sheave wheels supporting the cable against gravity.

* * * * *